US010607588B2

(12) United States Patent
Berg

(10) Patent No.: US 10,607,588 B2
(45) Date of Patent: Mar. 31, 2020

(54) FREE FORM MODULAR PICKUP SYSTEM

(71) Applicant: Sean Michael Berg, Rice Lake, WI (US)

(72) Inventor: Sean Michael Berg, Rice Lake, WI (US)

( * ) Notice: Subject to any disclaimer, the term of this patent is extended or adjusted under 35 U.S.C. 154(b) by 76 days.

(21) Appl. No.: 15/691,710

(22) Filed: Aug. 30, 2017

(65) Prior Publication Data

US 2018/0061389 A1 Mar. 1, 2018

Related U.S. Application Data

(60) Provisional application No. 62/381,600, filed on Aug. 31, 2016.

(51) Int. Cl.
*G10H 3/18* (2006.01)
*G10D 1/08* (2006.01)

(52) U.S. Cl.
CPC ..... *G10H 3/183* (2013.01); *G10D 1/085* (2013.01); *G10H 3/181* (2013.01); *G10H 2220/565* (2013.01)

(58) Field of Classification Search
CPC ..... G10H 3/183; G10H 3/181; G10D 1/085
See application file for complete search history.

(56) References Cited

U.S. PATENT DOCUMENTS 5,072,646 A * 12/1991 Valkama ..... G10H 3/182 84/726
7,105,731 B1 * 9/2006 Riedl ..... G10H 3/181 84/200
2009/0025543 A1 * 1/2009 Swartz ..... G10H 3/143 84/727
2012/0210848 A1 * 8/2012 Yamanaka ..... G10H 3/181 84/726
2013/0333545 A1 * 12/2013 Dunwoodie ..... G10H 3/181 84/726
2015/0317966 A1 * 11/2015 Liptac ..... G10H 1/32 84/735
2018/0197518 A1 * 7/2018 Ma ..... G10H 3/181

FOREIGN PATENT DOCUMENTS

GB 2173032 A * 10/1986
JP 2005043850 A * 2/2005

* cited by examiner

*Primary Examiner* — Daniel J Colilla
(74) *Attorney, Agent, or Firm* — Michael R Shevlin

(57) ABSTRACT

The present invention discloses a modular pickup system that is integrated into an electric guitar that facilitates quick change-out of pickups, free form repositioning of pickups, switch assignment of pickups to the guitar's pickup switch positions or phase (polarity) selection of the pickups.

30 Claims, 14 Drawing Sheets

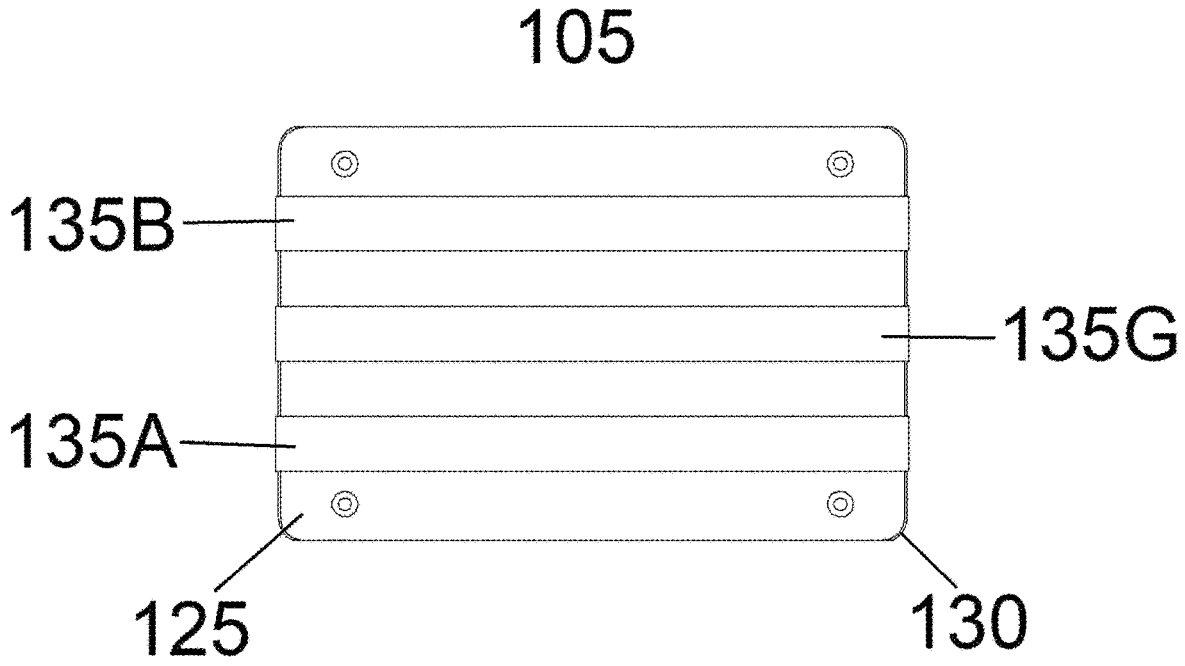
Figure 3A
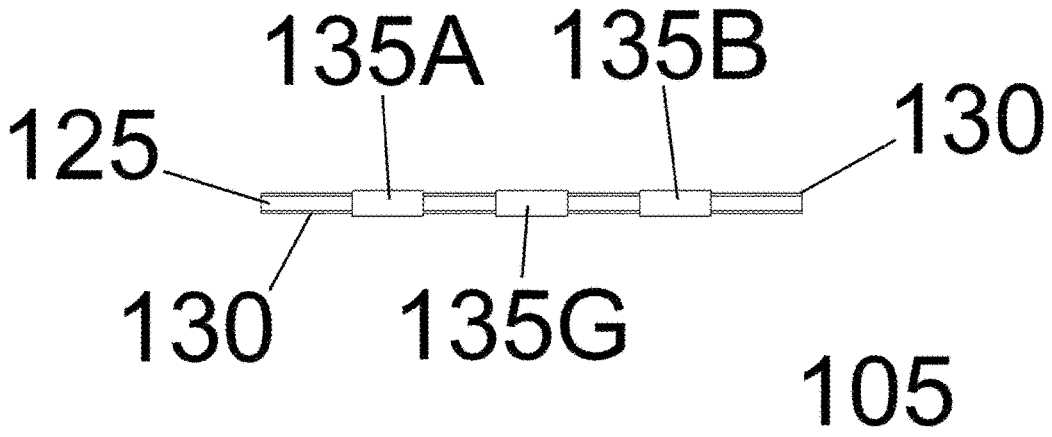
Figue 3B

FREE FORM MODULAR PICKUP SYSTEM

CROSS-REFERENCE TO RELATED APPLICATIONS

This application claims priority from U.S. Provisional Patent Application No. 62/381,600, filed on Aug. 31, 2016, the contents of which is incorporated herein by reference.

FIELD

The present invention relates to field of musical instruments, specifically a pickup used on an electric stringed instrument, such as an electric guitar.

BACKGROUND

At present, if you want to adjust or change your pickups, especially if you want to move them to the left or right, or place them at an angle, then you typically have to disassemble the guitar, likely remove wood from the guitar, and alternately cut and/or replace the pickguard with a new one, just to find out if your new pickup arrangement works to your satisfaction.

Prior solutions to this problem include several plug in style modular pickup designs and sliding pickup designs, some dating back more than 40 years.

For existing modular pickup solutions, there are typically a finite number of pickups that can be plugged in to the guitar, and their position in the guitar cannot be changed. For existing sliding pickup solutions, there are either one or two pickups in the guitar and their range of motion for position change is limited to a predetermined path.

It would be desirable to make a guitar pickup design that is not only truly modular, but allows infinite placement possibilities.

SUMMARY OF THE INVENTION

The present invention discloses a modular pickup system that is integrated into an electric guitar that facilitates quick change-out of pickups, free form repositioning of pickups, switch assignment of pickups to the guitar's pickup switch positions or phase (polarity) selection of the pickups.

Prior approaches have never considered that pickups in a guitar could be modularized in a free form fashion. At best, the sliding pickup solutions have only looked at pickup movement in one direction, and the modular pickup solutions have not considered movement at all, only plugging in pickups using a plug and jack. Even when observed, the invention is not obvious to the observer unless demonstrated and explained at the same time. After some time the observer suddenly realizes what this is, and are dumfounded.

The present invention provides endless adjustablility to the tone qualities of the pickup modules. It is easy and convenient to be able to mix and match multiple pickups and observe the results in realtime. The time saved by being able to do these things is literally thousands fold, and that getting the sound you want out of your guitar is now possible for everyone, not just professional service people and proficient tinkerers. These things were not possible before.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE DRAWINGS

The present embodiments may be understood from the following detailed description when read in conjunction with the accompanying figures. It is emphasized that the various features of the figures are not necessarily to scale. On the contrary, the dimensions of the various features may be arbitrarily expanded or reduced for clarity.

FIGS. 3A-3D are top, front, side and back views showing one embodiment of a pickup base.

DETAILED DESCRIPTION

Embodiments of the invention will now be described with reference to the figures, wherein like numerals reflect like elements throughout. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Modular Pickup System

Figure 1A:
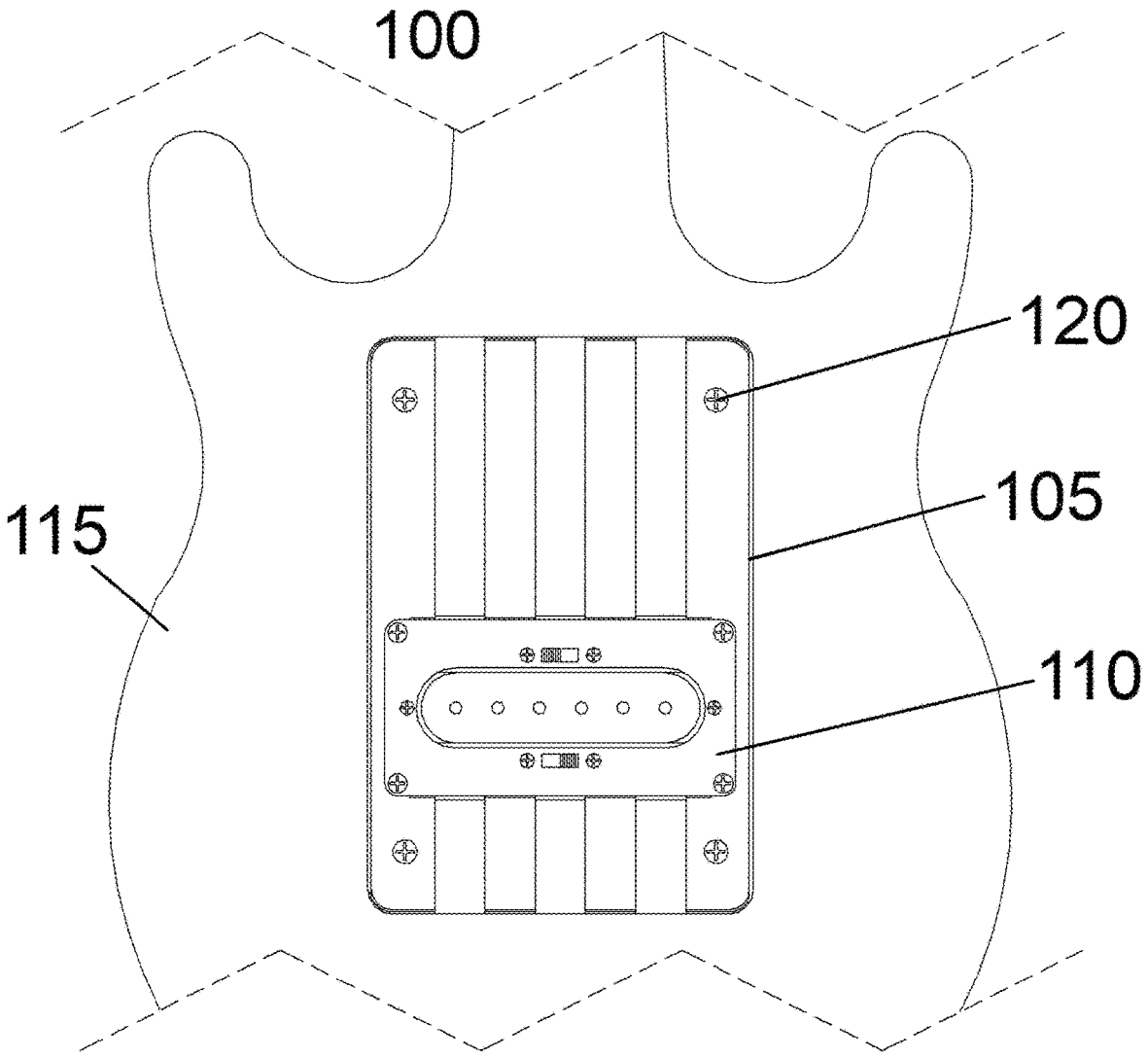
FIGS. 1A and 1B are front and side views showing one embodiment of a free form modular pickup system installed in a guitar.
Figure 1B:
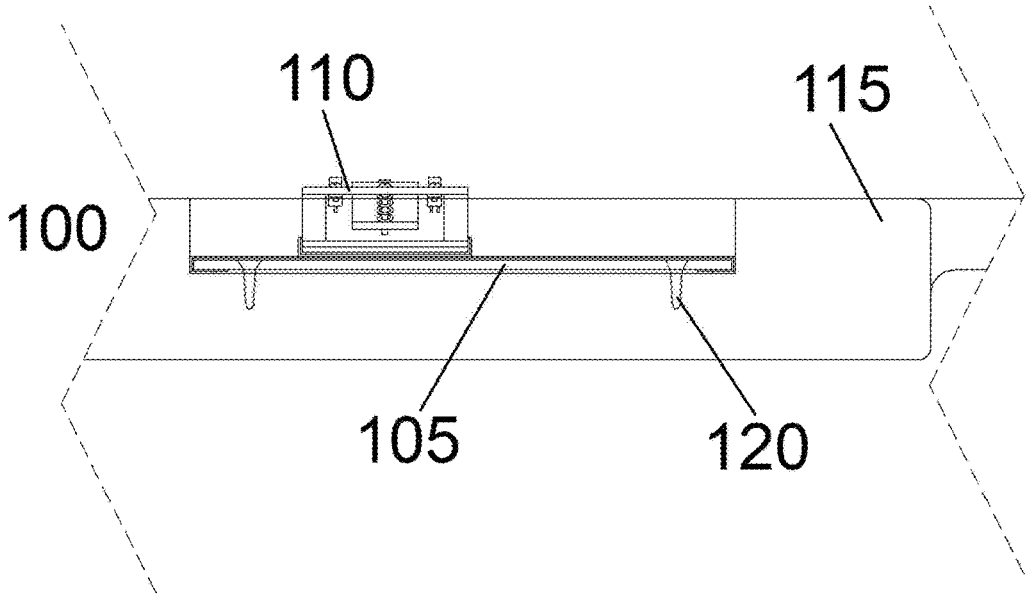

FIGS. 1A and 1B are front and side views showing one embodiment of a free form modular pickup system 100 that includes a modular pickup base 105 and modular pickup module 110. When integrated into an electric guitar 115, the modular pickup system 100 facilitates quick change-out of pickups, free form repositioning of pickups, switch assignment of pickups to the guitar's pickup switch positions or phase (polarity) selection of the pickups. The modular pickup system 100 may be attached to the electric guitar 115 using screws 120 or other known attachment means, such as adhesives, double-sided tape, etc.

Figure 2:
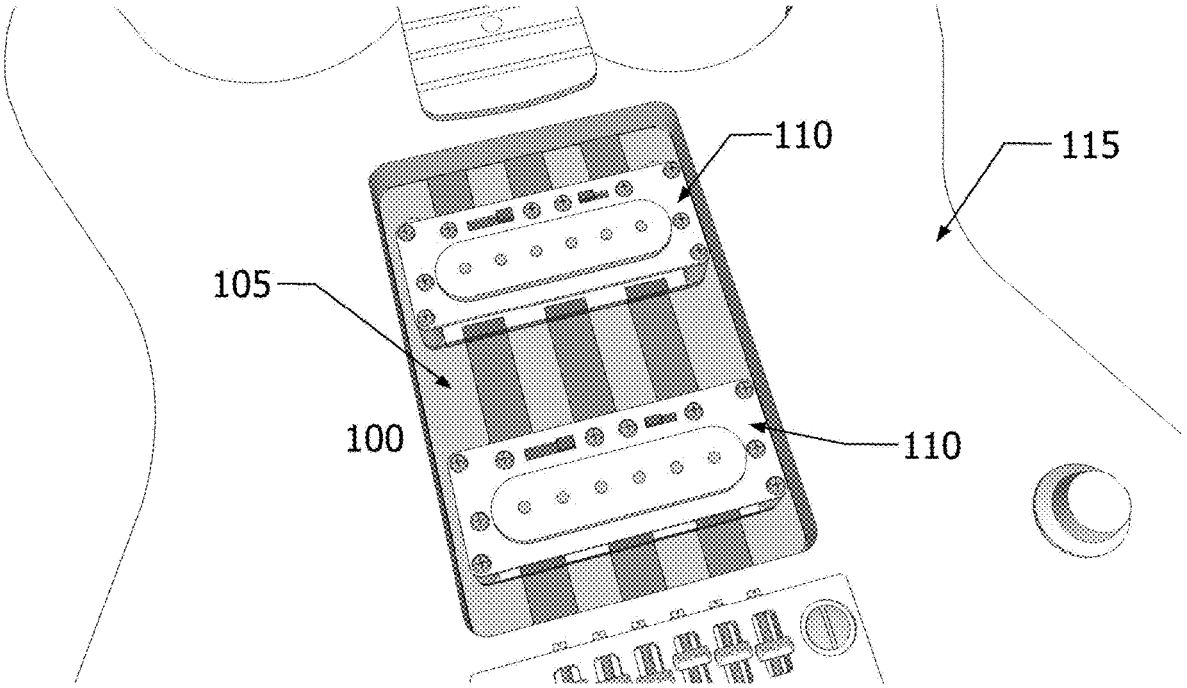
FIG. 2 shows another embodiment of a free form modular pickup system installed in a guitar having two pickup modules.
Figure 3C:
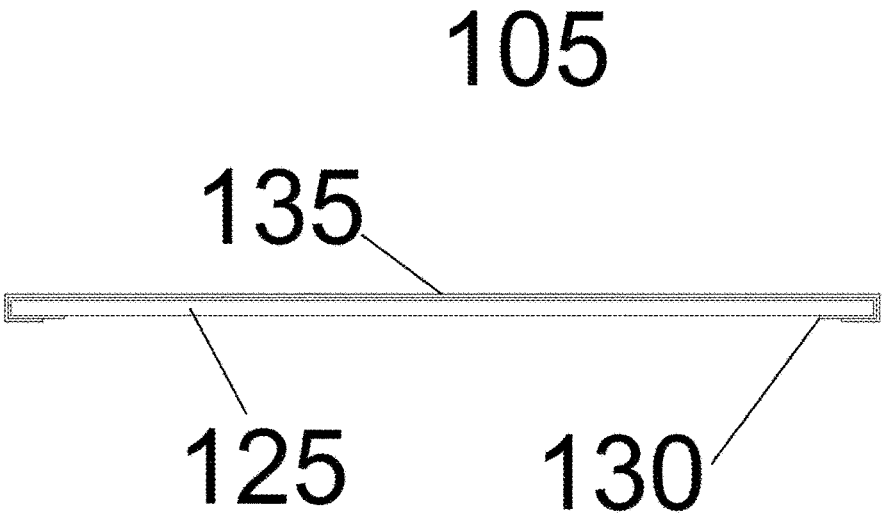
Figure 3D:
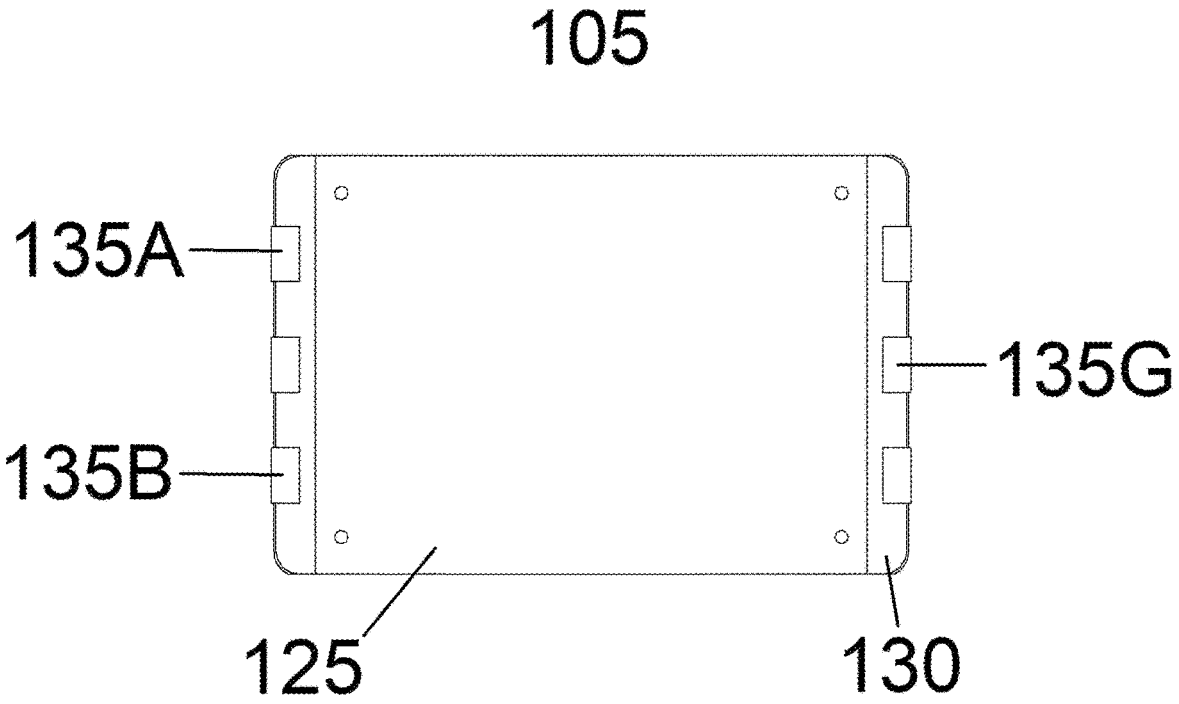

FIG. 2 shows another embodiment of a free form modular pickup system 100 installed on an electric guitar 115. In this embodiment, the free form modular pickup system 100 includes two modular pickup modules 110A and 110B mounted on the modular pickup base 105 in a pickup cavity of the guitar.

When the pickup modules are sitting on the pickup plate, it looks as though they are held in place by a physical retainer, and that they are hard-wired to the guitar. It is not obvious that they are held in place by magnetic force or that they are connected to the guitar via conductive strips.

Any size of pickup can be used. The pickups can be moved virtually anywhere within a two dimensional plane and in real time, including at an angle and side to side. The only limit to the number of pickups that can be installed is the size of the pickup cavity in the guitar relative to the size of the pickup modules, and these can be mixed or matched in real time.

The pickup modules may contain configuration switches for the type of pickup that is installed in the modules. For instance, single coil modules can switch phase (polarity) and humbucker modules can switch from series to parallel.

The pickup modules are assignable to any of a number of pickup selector switch positions, or they can be disabled.

Pickup Base

FIGS. 3A-D show a top view, front view, side view and bottom view of one embodiment of the pickup base 105 having a base plate 125, an insulating film 130, at least one conductive strip 135A and a ground strip 135G. In the embodiment shown, the insulating film 130 covers the upper surface and part of the bottom surface of the base plate 125. The conductive strips 135 are then mounted on the insulating surface 130. The figures show two conductive strips, channel A 135A and channel B 135B. While two channels are shown in the figures, any number of channels will work.

The base plate 125 may be a steel plate that attracts a magnetic strip mounted to the Pickup Module, allowing the Pickup Module to magnetically hold to the Pickup Base when placed on it. The steel plate 125 of the Pickup Base 105 is electrically connected to the ground strip or node 135G of the Pickup Base, providing electrical shielding to the Pickup Base circuit. The conductive strips 135 on the Pickup Base are electrically connected to the pickup wiring of the guitar, and allow the Pickup Module 110 to make electrical contact when placed on the Pickup Base 105, providing for the pickups in the Pickup Module to be connected to the guitar's wiring. The Pickup Base accommodates up to two channels of pickup signal. For Pickup Base electrical connections see FIGS. 9 and 10.

Figure 4:
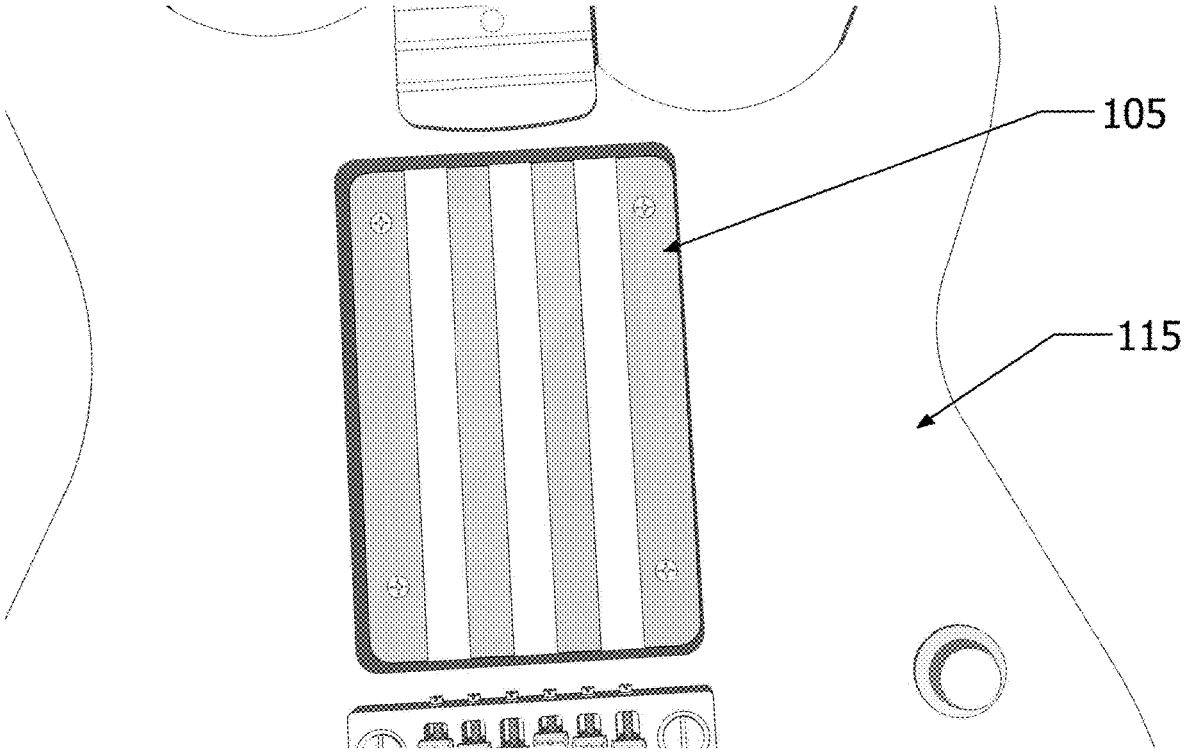
FIG. 4 shows a pickup base installed in a guitar.
Figure 5A:
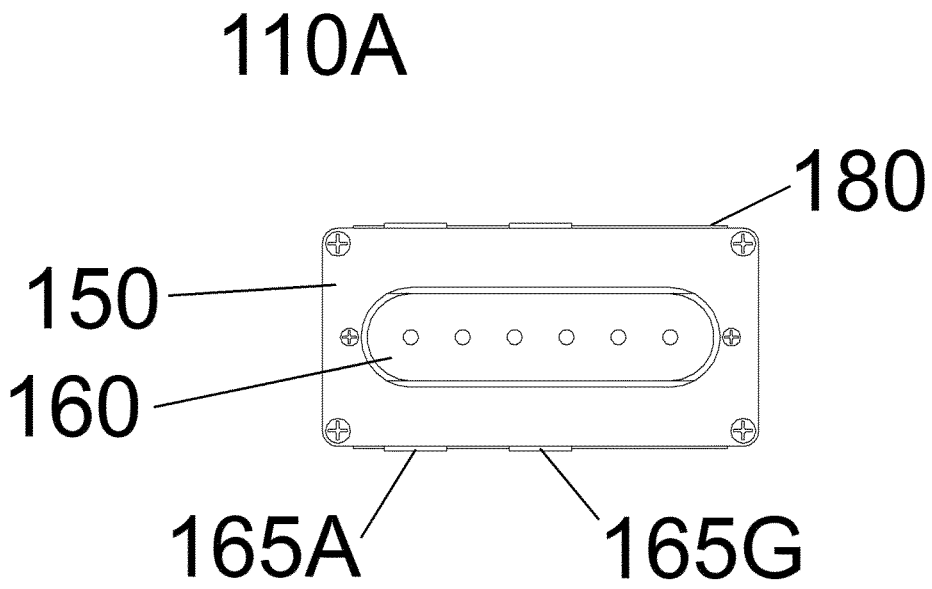
FIGS. 5A-5D are top, front, side and back views showing one embodiment of a pickup module with a single coil pickup with conductive strips installed for a single channel.
Figure 5B:
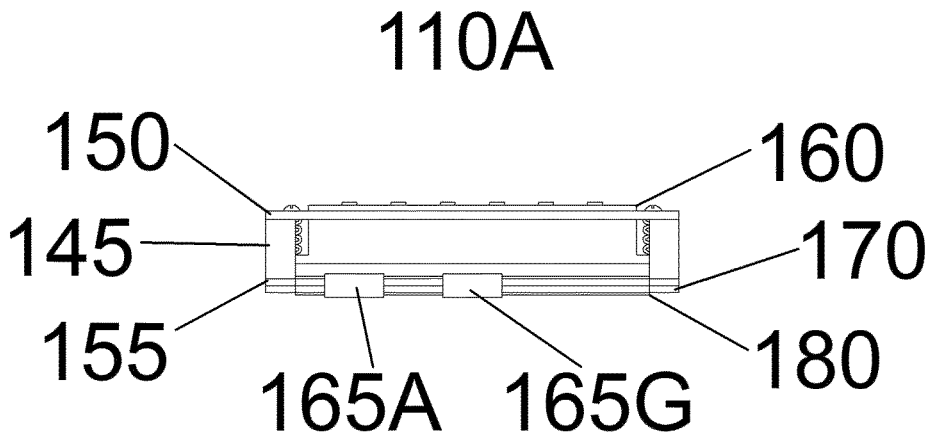
Figure 5C:
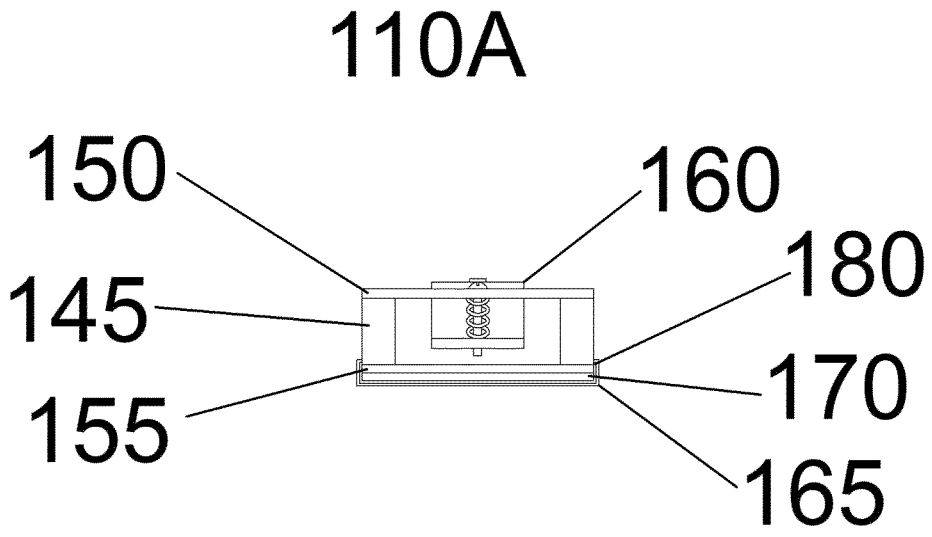
Figure 5D:
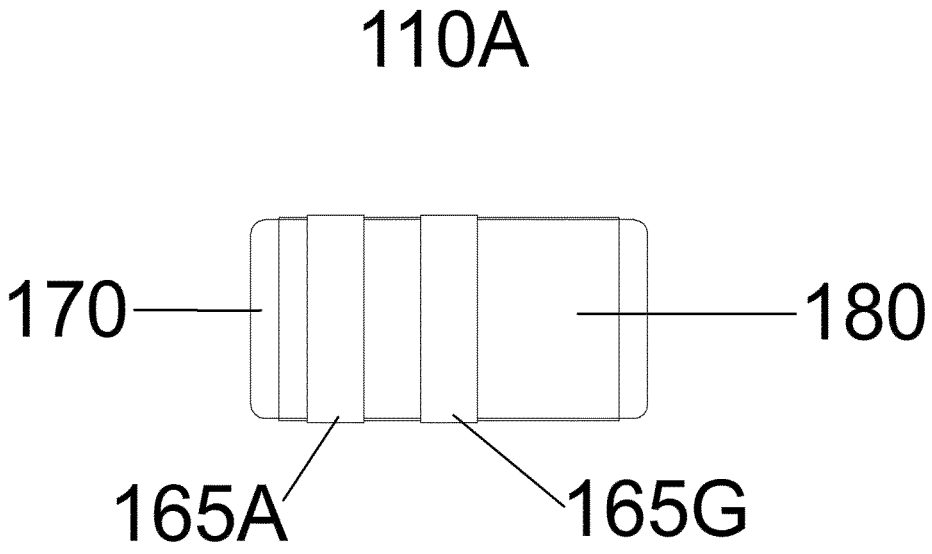
Figure 6A:
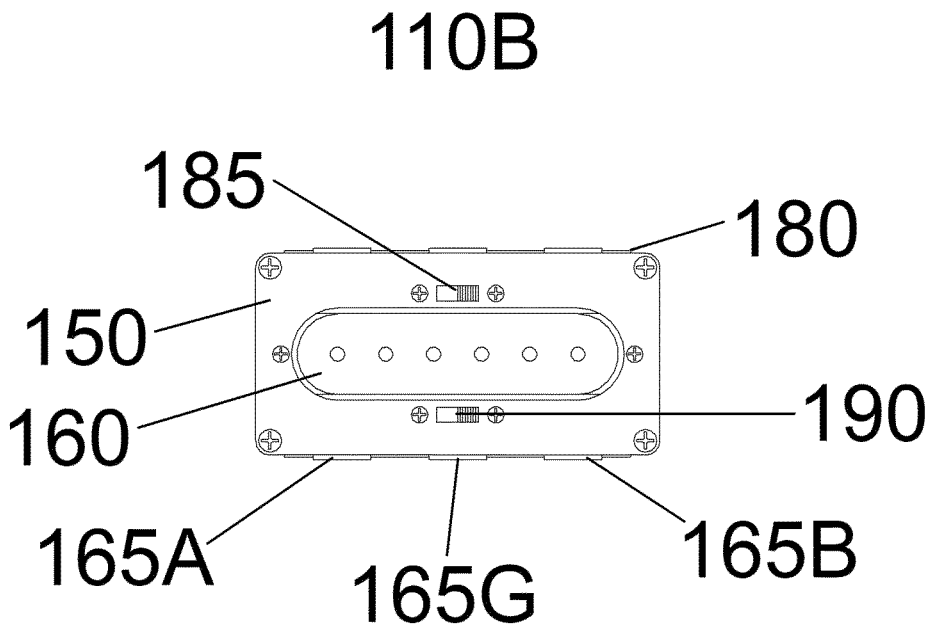
FIGS. 6A-6D are top, front, side and back views showing another embodiment of a pickup module with a single coil pickup with conductive strips for two channels with an optional channel switch.
Figure 6B:
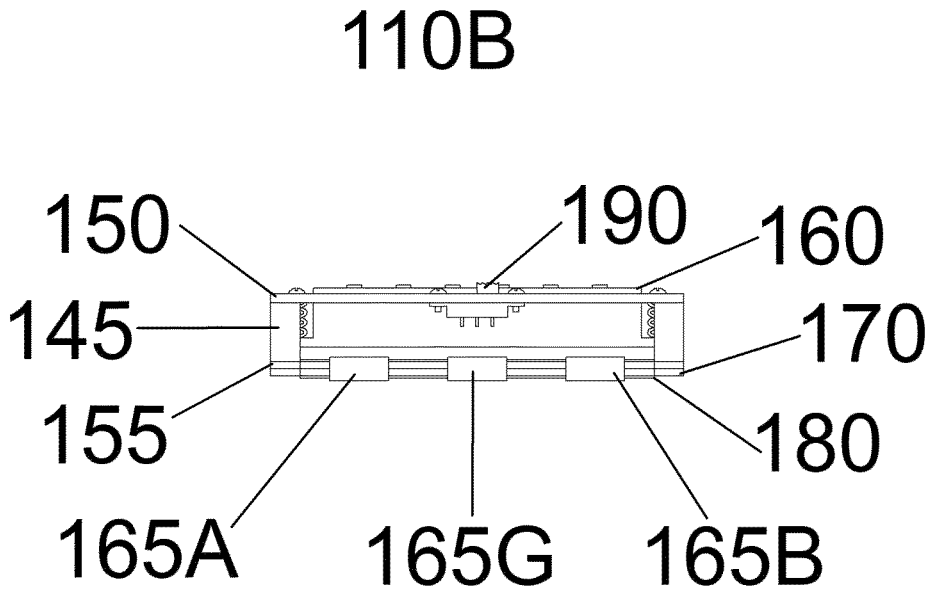
Figure 6C:
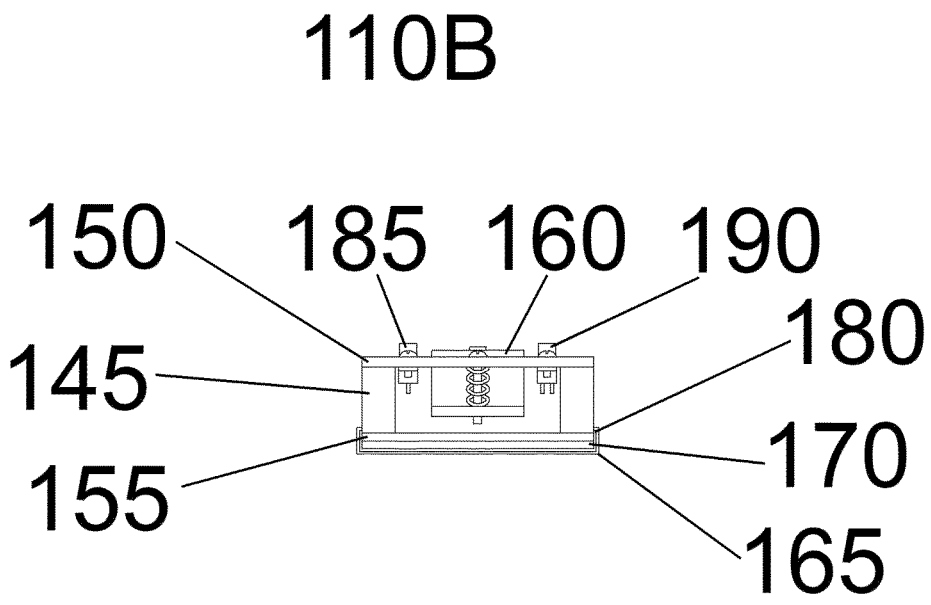
Figure 6D:
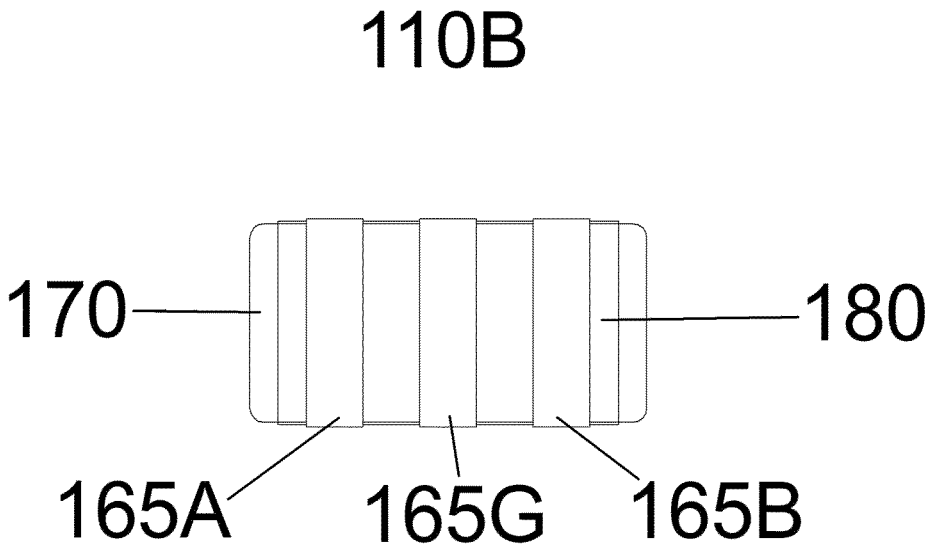

FIG. 4 shows the modular pickup base 105 installed on an electric guitar 115.

Pickup Module

FIGS. 5A-5D shows one embodiment of the pickup module 110A in the form of an electrically shielded container 145 includes a top plate 150 and a bottom plate 155. An electric guitar pickup 160 is mounted in the electrically shielded container 145 and electrically connected to conductive strips, strip 165A for channel A and strip 165G for a ground node. The strips 165 are mounted to the underside of a flat magnetic strip 170 which in turn is mounted to the underside of the bottom plate 155. The bottom plate 155 is electrically conductive, and is connected to a ground node of the pickup module, providing electrical shielding to the pickups. Between the conductive strips 165 and the magnetic strip 170 is a layer of thin insulating film 180. The pickup module may also include a phase switch 185 (shown in FIG. 6).

The conductive strips 165 are used to electrically connect the pickup module 110A to the pickup base 105 when the pickup module 110 is placed on the pickup base 105, thereby connecting the electric guitar pickup 160 to the guitar's wiring. The magnetic strip 170 is used to magnetically hold the pickup module 110 to the pickup base 105 when placed on the base, allowing repositioning of the pickup module 110 along the surface of the base 105 while holding it to the guitar.

FIGS. 6A-6D shows another embodiment of pickup module 110B for a two channel similar to 110A above with an additional conductive strip 165B for channel B. The strip 165B is mounted to the underside of the flat magnetic strip 170 mounted to the bottom plate 155. Between the conductive strip 165B and the magnetic strip 170 is a layer of thin insulating film 180. The pickup module 110 may also include switches used for phase (polarity) selection of the pickups 185 or channel assignment of pickups to the guitar's pickup 190. The channel selection switch 190 is used to select different channels (such as A or B). It may also include an off position.

Figure 7:
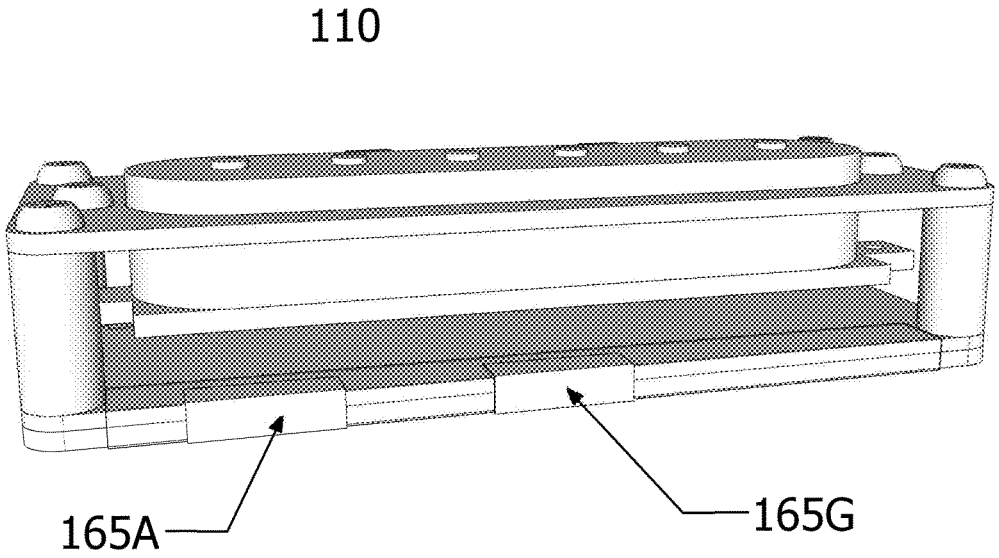
FIG. 7 shows a pickup module.

FIG. 7 shows a perspective view of the pickup module 110.

Figure 8:
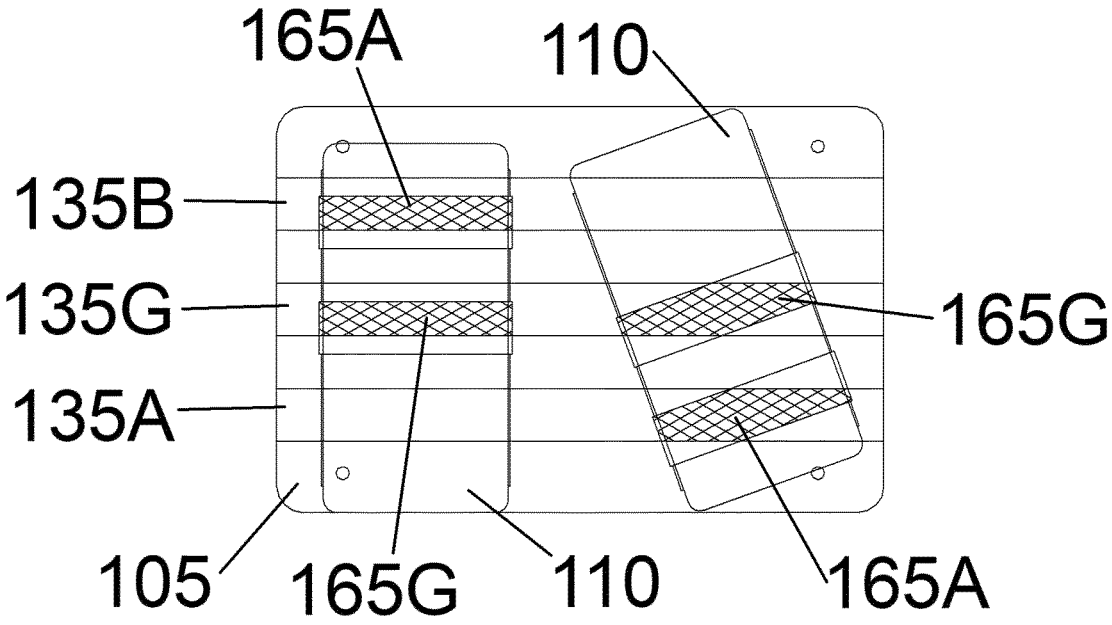
FIGS. 8 and 9 are diagrams of pickup modules mounted on the pickup base in various positions.
Figure 9:
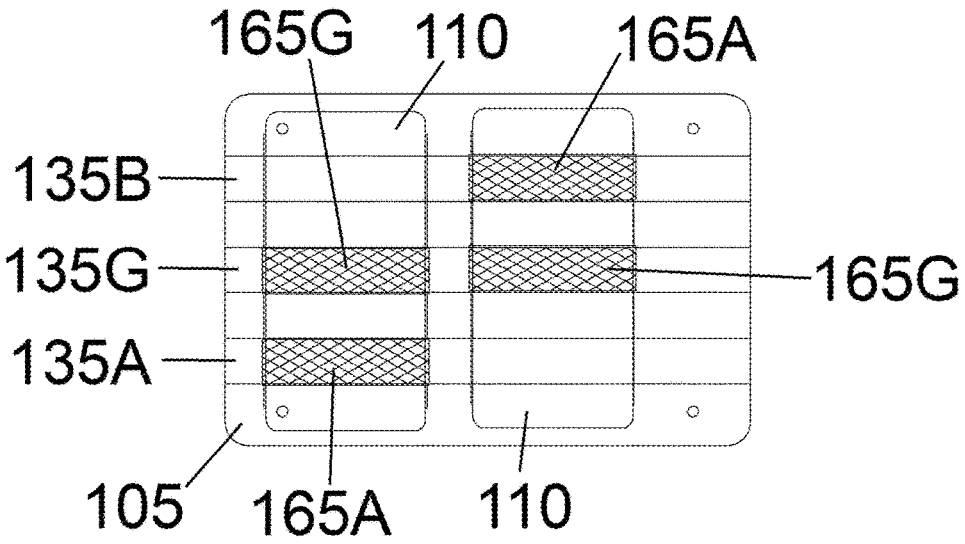

FIGS. 8 and 9 shows diagrams of the pickup module 110 mounted to the pickup base 105 in various positions. The modules are shown without pickups and with the conductive strips seen through the top to demonstrate the electrical contact with the conductive strips on the pickup base 105.

In FIG. 8, the upper module 110A is shown shifted to the edge of the pickup base 105, and the lower module 110A is shown in a slightly rotated position on the pickup base 105.

In FIG. 9, the upper module 110A is shown connected to channel A and the lower module 110A is connected to Channel B. In this configuration, the upper module is shown with conductive strip 165A of the module 110 in contact with conductive strip channel A 135A of the base 105 and the lower module is upper module 110 is rotated 180 degrees so that conductive strip 165A of the module is in contact with conductive strip channel B 135B of the base 105.

Features

The present invention provides many advantages and features over the prior art including:

- Multiple Pickup Modules can be added to the Pickup Base.
- A Pickup Module can be placed anywhere on the Pickup Base and positioned to one or more desired locations.
- The basic Pickup Module can be turned 180 degrees to connect to either channel A or Channel B of the Pickup Base.
- Multiple Pickup Modules can be connected to a single channel of the Pickup Base.

A Pickup Module can be shifted about ¼" left or right of its center position.

A Pickup Module can be turned from 0 to about 20 degrees left or right of perpendicular to the length of the Pickup Base.

A Pickup Module with the optional Channel Assign Switch installed can connect to either channel A or B of the Pickup Base without being rotated or removed.

A Pickup Module with the optional Phase Switch installed can have phase or polarity of the pickup reversed without rewiring the module.

System Schematic

Figure 10:
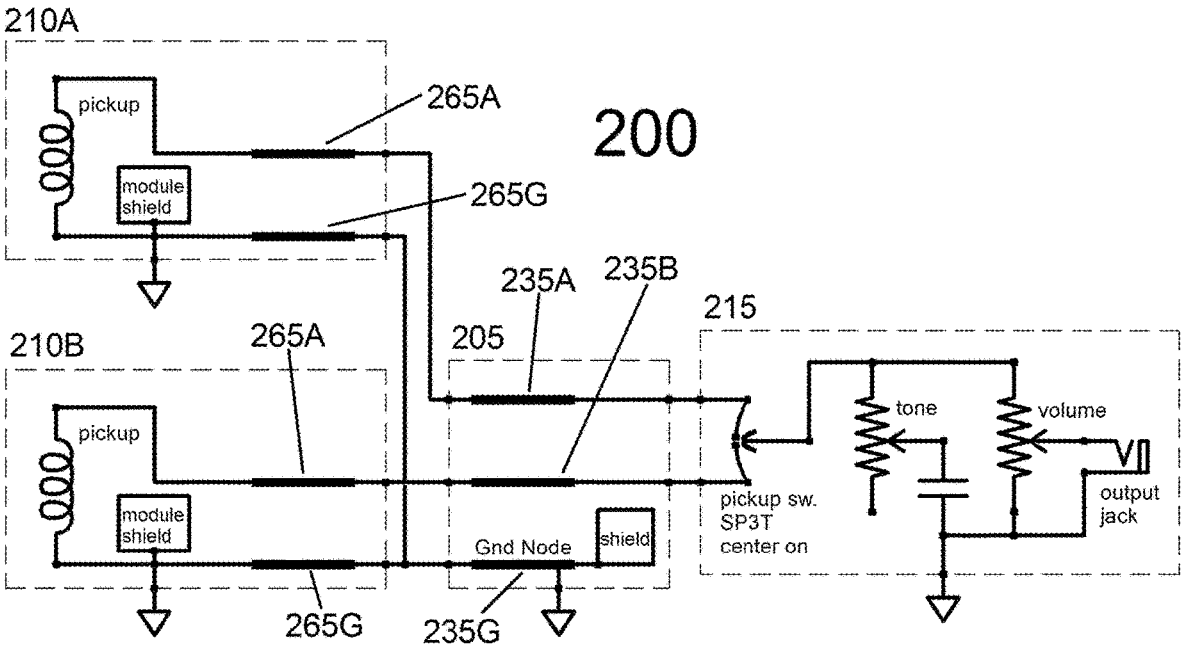
FIG. 10 shows one embodiment of a system schematic of a free form pickup system installed on a guitar.

FIG. 10 shows one embodiment of schematics for modular pickup system schematic 200 including a pickup base 205, pickup modules 210A, 210B and a guitar 215. The pickup base 205 channels A and B are coupled to the guitar pickup. The pickup modules 210A, 210B may then be coupled to the pickup base 205 as described above.

Pickup Base Schematic

Figure 11:
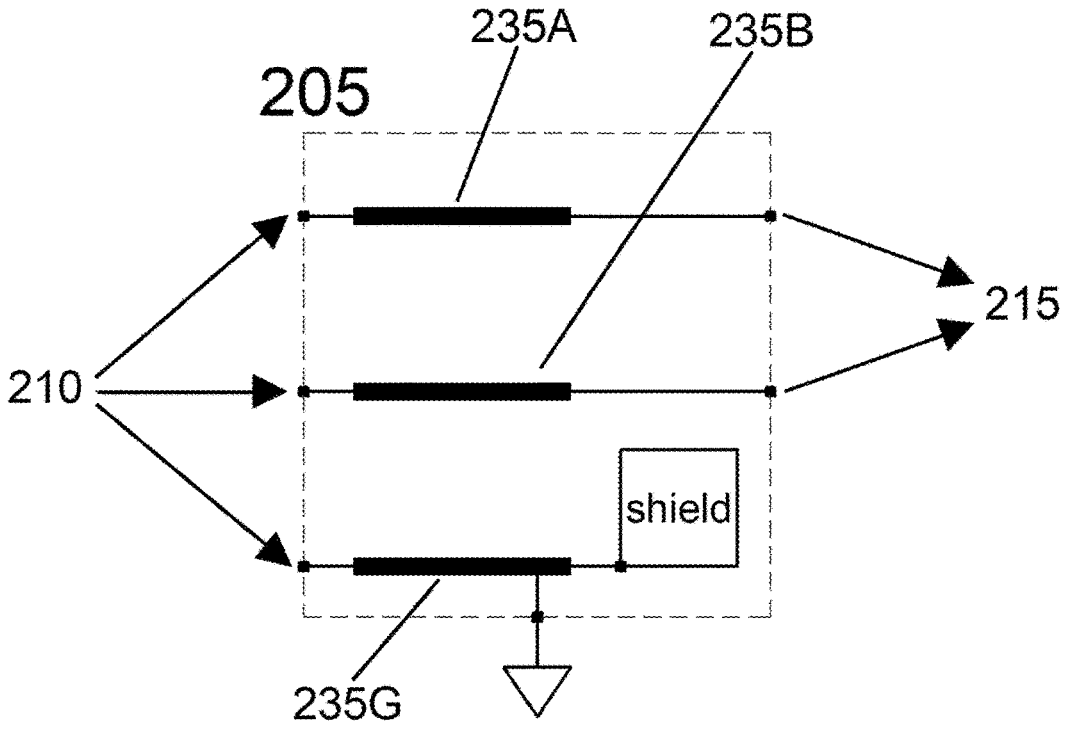
FIG. 11 shows one embodiment of a schematic of a pickup base.

FIG. 11 shows one embodiment of a pickup base 205 having conductive strips 235A for channel A, 235B for channel B and 235G for a ground. Conductive strips 235A and 235B are coupled to the guitar wiring. The pickup modules strips 265 may then be couple to the pickup base strips 235 in many different configurations, described below.

Pickup Module Schematics

Figure 12:
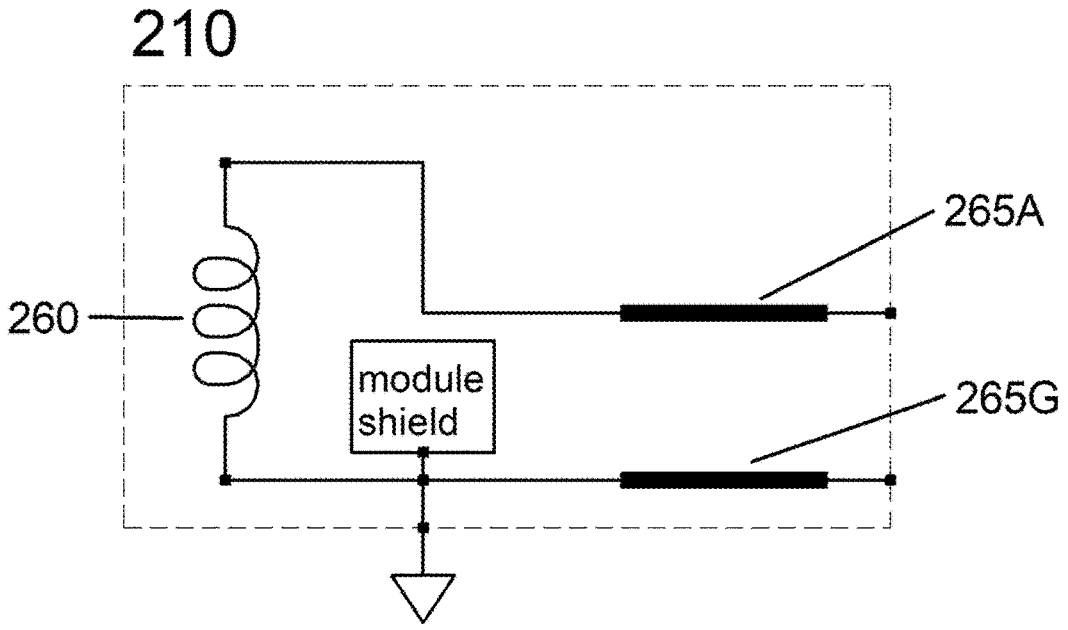
FIG. 12 shows one embodiment of a schematic of a pickup module set up for a single channel connection.

FIG. 12 shows one embodiment of a pickup module 210 for a single channel connection having pickup 260 coupled to conductive strips 265A for a channel and 265G for a ground. Conductive strip 265A may be coupled to either pickup base strips 235A (for channel A) or 235B (for channel B) depending on pickup module 210A orientation (see FIGS. 8 and 9). Conductive strip 265G is coupled to pickup base strip 235G.

Figure 13:
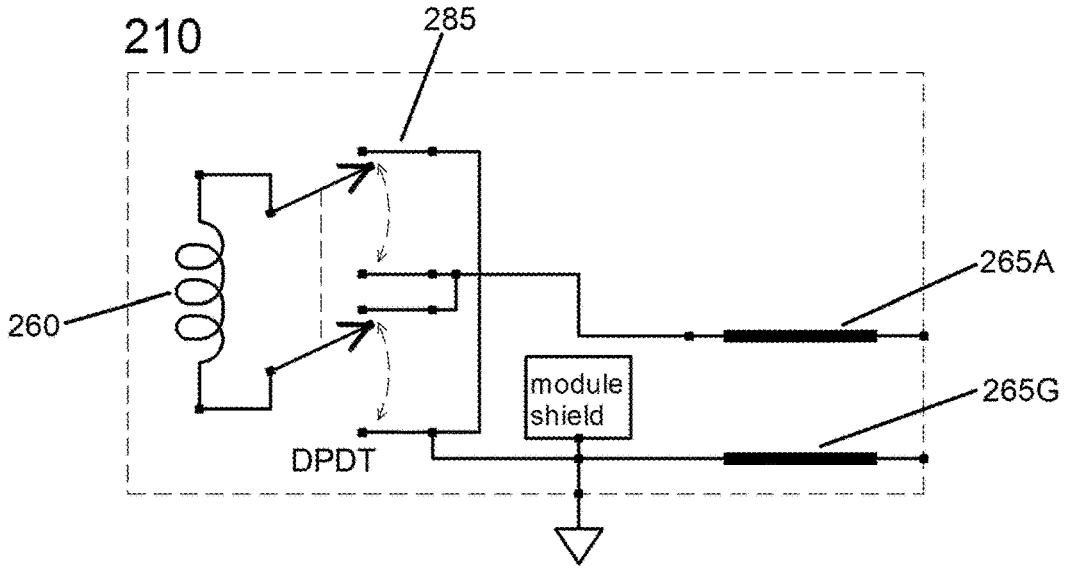
FIG. 13 shows one embodiment of a schematic of a pickup module set up for a single channel connection with a phase switch.

FIG. 13 shows another embodiment of a pickup module 210 for a single channel connection having pickup 260 with phase switch 285 coupled to conductive strips 265A for channel A and 265G for a ground.

Figure 14:
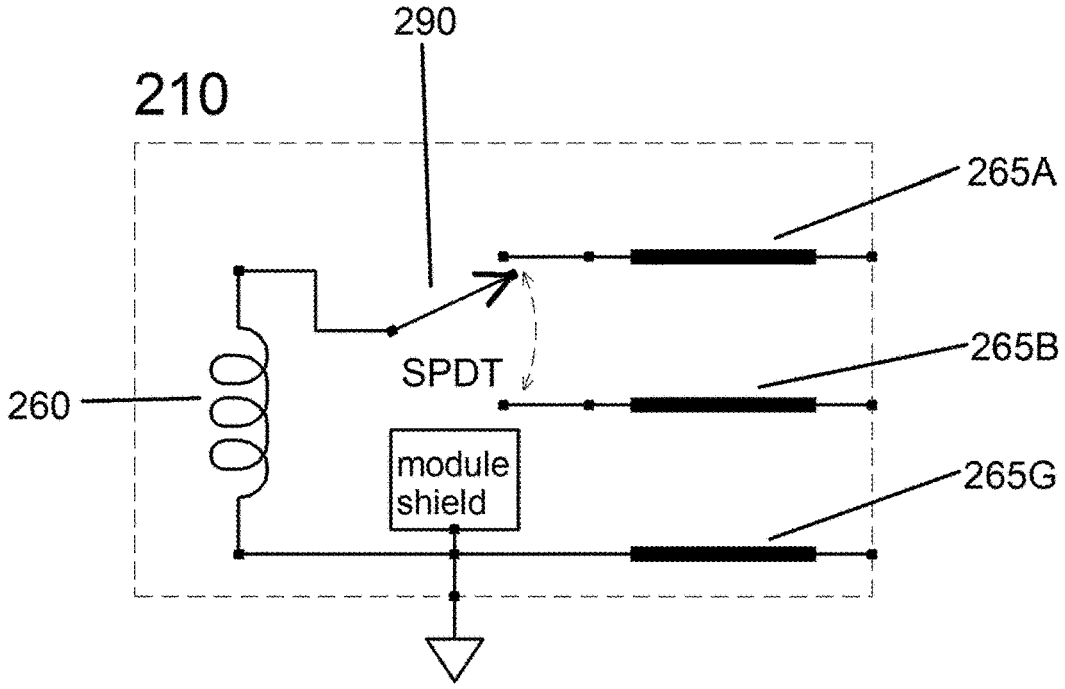
FIG. 14 shows one embodiment of a schematic of a pickup module with a channel assign switch.

FIG. 14 shows one embodiment of a pickup module 210 for a two channel connection having pickup 260 with channel assign switch 290 coupled to conductive strips 265A for a channel A, 265B for channel B and 265G for a ground. The pickup conductive strip 265A may be coupled to base strip 235A (for channel A) and 265B coupled to 235B (for channel B). Conductive strip 265G is coupled to pickup base strip 235G.

Figure 15:
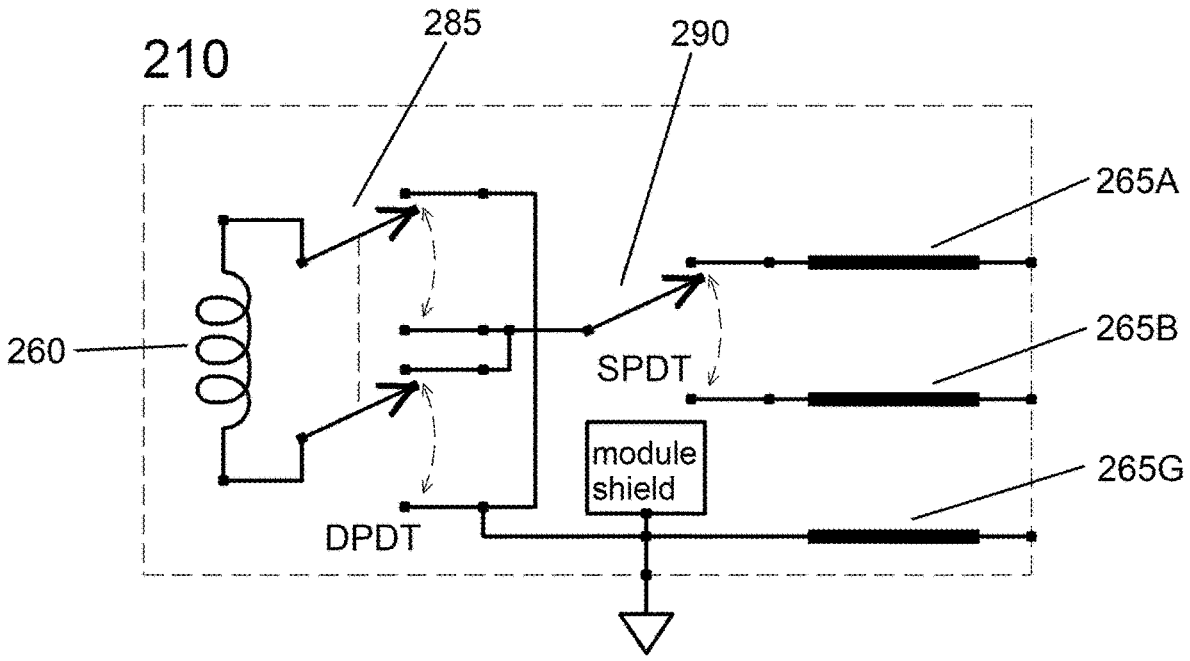
FIG. 15 shows one embodiment of a schematic of a pickup module with a channel assign switch and phase switch.

FIG. 15 shows another embodiment of a pickup module 210 for a single channel connection having pickup 260 with phase switch 285 and phase channel assign switch 290 coupled to conductive strips 265A for a channel A, 265B for channel B and 265G for a ground.

Figure 16:
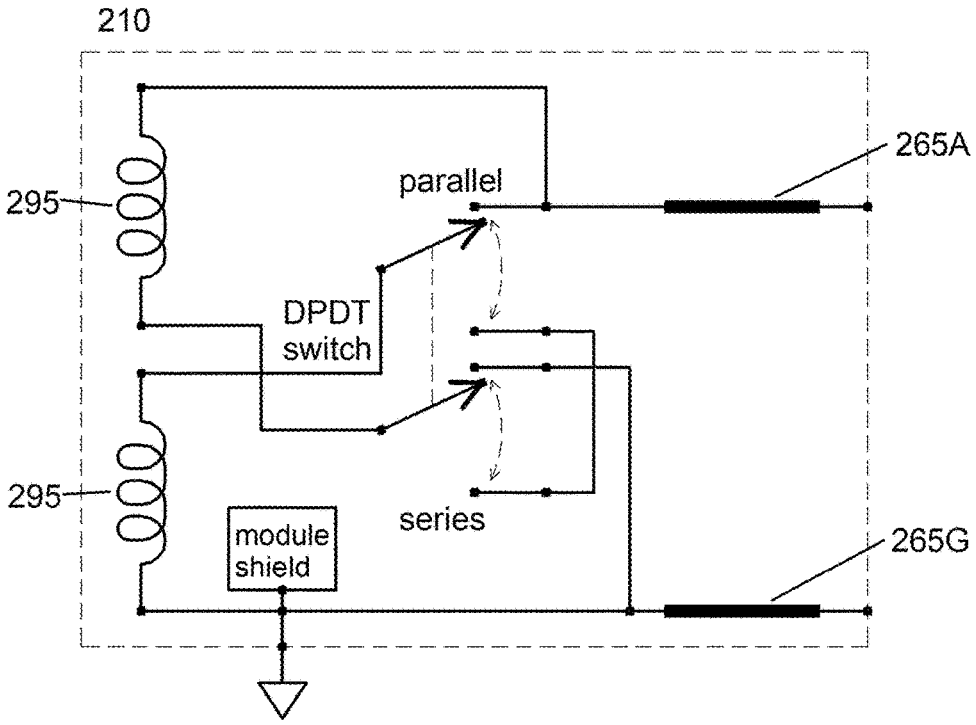
FIG. 16 shows one embodiment of a schematic of a pickup module set up for a single channel connection with humbucker series/parallel switch.

FIG. 16 shows one embodiment of a pickup module 210 for a single channel connection having humbucker pickups 295 with a series/parallel switch coupled to conductive strips 265A for a channel and 265G for a ground.

While embodiments and applications of this invention have been shown and described, it would be apparent to those skilled in the art that many more modifications than mentioned above are possible without departing from the inventive concepts herein. It is to be understood that the present disclosure is illustrative only and that changes, variations, substitutions, modifications and equivalents will be readily apparent to one skilled in the art and that such may be made without departing from the spirit of the invention as defined by the following claims.

The invention claimed is:

1. A free form modular pickup system comprising:

a modular pickup base having pickup base conductive strips including:

a pickup base conductive channel A strip, a pickup base conductive channel B strip, and a pickup base conductive ground strip electrically connected to a pickup wiring of a guitar; and a modular pickup module having pickup module conductive strips including:

a pickup module conductive channel A strip, a pickup module conductive channel B strip, and a pickup module conductive ground strip, wherein, when the pickup module is placed on the pickup base:

the pickup module conductive channel A strip is electrically connected to the pickup base conductive channel A strip, the pickup module conductive channel B strip is electrically connected to the pickup base conductive channel B strip, and the pickup module conductive ground strip is electrically connected to the pickup base conductive ground strip;

thereby connecting the modular pickup module conductive strips to the wiring of the guitar.

2. The free form modular pickup system of claim 1, wherein the pickup module is magnetically coupled to the pickup base.

3. The free form modular pickup system of claim 1, wherein the pickup module may be rotated in relation to the pickup base.

4. The free form modular pickup system of claim 1, wherein the pickup base conductive strips include multiple conductive strips for channels and a ground node.

5. The free form modular pickup system of claim 1, wherein the pickup module conductive strips include multiple conductive strips for channels and a ground node.

6. The free form modular pickup system of claim 1, wherein the pickup module includes a channel assignment switch configured to select channel A or channel B.

7. The free form modular pickup system of claim 1, wherein the pickup module includes a phase switch configured for phase (polarity) selection of the pickup strips.

8. The free form modular pickup system of claim 1, wherein the tone quality of the pickup module is adjustable by rotational or side to side movement in relation to the pickup base.

9. The free form modular pickup system of claim 8, wherein the rotational or side to side movement of the pickup module may be in realtime.

10. The free form modular pickup system of claim 1, wherein the pickup module is multiple modular pickup modules configured to be positioned on the pickup base.

11. The free form modular pickup system of claim 10, wherein the multiple modular pickup modules may be connected to a single channel or multiple channels on the pickup base.

12. The free form modular pickup system of claim 10, wherein the number of multiple modular pickup modules may be mixed and matched in realtime.

13. The free form modular pickup system of claim 10, wherein the multiple modular pickup modules can be separately turned 180 degrees to connect to either channel A or Channel B of the Pickup Base.

14. The free form modular pickup system of claim 1, wherein the pickup module may be placed anywhere on the pickup base.

15. A free form modular pickup system for quick change-out of pickups comprising:

a modular pickup base having:

a pickup base conductive channel A strip, a pickup base conductive channel B strip, and a pickup base conductive ground strip electrically connected to a pickup wiring of a guitar; and a modular pickup module having pickup module conductive channel strips including:

a pickup module conductive channel strip, and a pickup module conductive ground strip, and wherein, when the pickup module is placed on the pickup base in a first orientation, the pickup module conductive channel strip is electrically connected to the pickup base conductive channel A strip, and when the pickup module is placed on the pickup base in a second orientation, the pickup module conductive channel strip is electrically connected to the pickup base conductive channel B strip, thereby connecting the modular pickup module to the wiring of the guitar.

16. The free form modular pickup system of claim 15, wherein the pickup module is magnetically coupled to the pickup base.

17. The free form modular pickup system of claim 15, wherein the pickup module may be rotated at an angle in relation to the to the pickup base.

18. The free form modular pickup system of claim 15, wherein the modular pickup module is rotated 180 degrees from the first orientation to the second orientation.

19. The free form modular pickup system of claim 15, wherein the pickup module includes a channel assignment switch.

20. The free form modular pickup system of claim 15, wherein the pickup module includes a phase switch.

21. The free form modular pickup system of claim 15, wherein the tone quality of the pickup module is adjustable by rotational or side to side movement in relation to the pickup base.

22. The free form modular pickup system of claim 21, wherein the rotational or side to side movement of the pickup module may be in realtime.

23. The free form modular pickup system of claim 15, wherein the pickup module is multiple modular pickup modules configured to be positioned on the pickup base.

24. The free form modular pickup system of claim 23, wherein the multiple modular pickup modules may be connected to a single channel or multiple channels on the pickup base.

25. The free form modular pickup system of claim 23, wherein the number of multiple modular pickup modules may be mixed and matched in realtime.

26. The free form modular pickup system of claim 23, wherein the multiple modular pickup modules can be separately turned 180 degrees to connect to either channel A or Channel B of the Pickup Base.

27. The free form modular pickup system of claim 15, wherein the pickup module may be placed anywhere on the pickup base.

28. An electric guitar with modular pickups comprising:

a guitar body having pickup wiring, a modular pickup base mounted on the guitar body, the modular pickup base having pickup base conductive strips including:

a pickup base conductive channel A strip, a pickup base conductive channel B strip, and a pickup base conductive ground strip electrically connected to the pickup wiring of the guitar; and a modular pickup module having pickup module conductive strips including:

one or more pickup module conductive channel strips, and a pickup module conductive ground strip electrically connected to the pickup base strips when the pickup module is placed on the pickup base, thereby connecting the modular pickup module to the guitar's wiring;

wherein the pickup modules may be remove and repositioned, rotated or replaced.

29. The free form modular pickup system of claim 28, wherein the one or more pickup module conductive channel strips includes:

one pickup module conductive channel strip that is electrically connected to either:

the pickup base conductive channel A strip in a first orientation, or the pickup base conductive channel B strip in a second orientation, wherein the first orientation is 180 degrees from the second orientation.

30. The free form modular pickup system of claim 28, wherein the one or more pickup module conductive channel strips includes:

two pickup module conductive channel strips that are electrically connected to:

a pickup module conductive channel A strip electrically connected to the pickup base conductive channel A strip and a pickup module conductive channel B strip electrically connected to the pickup base conductive channel B strip.

* * * * *